US009121602B2

(12) United States Patent
Van Wyk et al.

(10) Patent No.: US 9,121,602 B2
(45) Date of Patent: Sep. 1, 2015

(54) STEAM GENERATOR

(76) Inventors: Russel Duane Van Wyk, Cary, NC (US); Dennis Allen Van Wyk, Eugene, OR (US)

( * ) Notice: Subject to any disclaimer, the term of this patent is extended or adjusted under 35 U.S.C. 154(b) by 889 days.

(21) Appl. No.: 13/311,271

(22) Filed: Dec. 5, 2011

(65) Prior Publication Data

US 2012/0137989 A1 Jun. 7, 2012

Related U.S. Application Data

(60) Provisional application No. 61/420,005, filed on Dec. 6, 2010.

(51) Int. Cl.

| | |
|---|---|
| ***F22B 9/00*** | (2006.01) |
| ***F22B 9/12*** | (2006.01) |
| ***F22B 35/00*** | (2006.01) |
| ***F22B 37/46*** | (2006.01) |

(52) U.S. Cl.

CPC . *F22B 9/12* (2013.01); *F22B 35/00* (2013.01); *F22B 37/46* (2013.01)

(58) Field of Classification Search

CPC ..... F24H 1/40; F24H 1/52; F22B 9/00; F22B 9/12; F22B 13/005; F22B 33/08

USPC ..... 122/51, 52, 47, 33, 49, 95.1, 44.1, 122/209.1, 214, 215, 216

See application file for complete search history.

(56) References Cited

U.S. PATENT DOCUMENTS

| | | | | |
|---|---|---|---|---|
| 473,251 | A * | 4/1892 | Cox et al. | 122/107 |
| 744,042 | A * | 11/1903 | Burk | 122/108 |
| 797,107 | A | 8/1905 | Haarmann | |
| 1,488,359 | A | 3/1924 | Lopez | |
| 3,392,711 | A | 7/1968 | Wolfersperger | |
| 3,793,994 | A | 2/1974 | Olsen | |
| 4,030,302 | A * | 6/1977 | Mankouski | 60/667 |
| 4,470,359 | A * | 9/1984 | Smith | 110/234 |
| 4,493,637 | A | 1/1985 | Ganter | |

(Continued)

FOREIGN PATENT DOCUMENTS

| | | |
|---|---|---|
| JP | 178057 A | 7/2007 |
| WO | WO00/50821 A1 | 8/2000 |

OTHER PUBLICATIONS

"Series X PowerFlameX4—The Versatile 4" Diameter Burner," 2001, 2pp., X4-0101 Rev. 0303, published by Power Flame Incorporated, Parsons, Kansas; downloadd from www.powerflame.com.

(Continued)

*Primary Examiner* — Steven B McAllister

*Assistant Examiner* — Ko-Wei Lin

(74) *Attorney, Agent, or Firm* — Jay M. Brown

(57) ABSTRACT

A steam generator including a steam chamber defining an enclosed fluid chamber with a plurality of tubes passing through the steam chamber, a combustion chamber defining a closed fluid chamber and an air channel coupled to a burner, and a heat transfer section defining a closed fluid chamber and an air passage in fluid communication with a vacuum source, in which the burner generates a heated air mixture, the vacuum source draws the heated air mixture from the combustion chamber air channel, through the steam chamber plurality of tubes and through the heat transfer section air passage so as to heat fluid passing through the heat transfer section, the steam chamber and the combustion chamber fluid chamber.

44 Claims, 3 Drawing Sheets

(56) References Cited

U.S. PATENT DOCUMENTS

| | | | | |
|---|---|---|---|---|
| 4,869,208 | A | 9/1989 | Adams | |
| 4,938,204 | A | 7/1990 | Adams | |
| 5,022,352 | A | 6/1991 | Osborne | |
| 5,271,215 | A | 12/1993 | Guillet | |
| 5,902,098 | A * | 5/1999 | Park | 431/6 |
| 5,968,320 | A * | 10/1999 | Sprague | 202/113 |
| 6,032,616 | A | 3/2000 | Jones | |
| 6,053,130 | A | 4/2000 | Shellenberger | |
| 6,394,042 | B1 | 5/2002 | West | |
| 6,508,645 | B1 | 1/2003 | George | |
| 6,585,785 | B1 | 7/2003 | Warren | |
| 2008/0011245 | A1 | 1/2008 | Donnelly | |
| 2009/0151653 | A1 * | 6/2009 | Mullen et al. | 122/18.3 |
| 2011/0061609 | A1 | 3/2011 | Van Wyk | |

OTHER PUBLICATIONS

PCT International Search Report in US2010/049075, dated Nov. 5, 2010, 2 pages.

PCT Written Opinion of the International Search Authority in US2010/049075, dated Nov. 5, 2010, 7 pages.

Canadian Office Action dated May 13, 2013 for co-pending Canadian Patent Applicaton No. 2,761,035.

"Wall" definition, downloaded on Mar. 18, 2015 from http://dictionary.reference.com/browse/wall, 3 pages.

* cited by examiner

STEAM GENERATOR

CLAIM OF PRIORITY

This application claims priority to U.S. Provisional Patent Application Ser. No. 61/420,005, filed Dec. 6, 2010, the entire disclosure of which is hereby incorporated in its entirety.

FIELD OF THE INVENTION

The present invention relates generally to steam generators. More particularly, the present invention relates to a gas, diesel, oil or biomass operated steam generator.

BACKGROUND

A continuous supply of hot steam is essential for the provision of many services in hotels, restaurants, hospitals and other public or private establishments. Hot steam is generally produced by boiling water under atmospheric pressure by directly heating a water vessel. Gas is widely used for generating hot steam. In conventional hot steam generating apparatuses using gas burners, a gas burner is placed underneath the bottom of a water vessel. Water contained in the vessel is heated by direct heating of the bottom of the water vessel by flames and heat generated by fuel gas combustion. In a conventional burner, the flames are pushed by gas pressure towards the bottom of the water vessel and spread over the bottom surface of the vessel, thereby heating the bottom surface of the vessel. However, conventional gas water steam generators are known to have relatively low thermal efficiency due to dissipation of the heat from the vessel into the atmosphere and also because the flame contact area only represents a small percentage of the combustion area. Typically, the thermal efficiency for conventional water steam generators or steam generators is below 80% for a large-size gas burner or for a heated water vessel with a flat vessel bottom.

The present invention recognizes and addresses disadvantages of prior art constructions and methods. Various combinations and sub-combinations of the disclosed elements, as well as methods of utilizing same, which are discussed in detail below, provide objects, features and aspects of the present invention.

BRIEF SUMMARY

One embodiment of the present invention provides a steam generator including a steam chamber with an enclosed body having an inner wall and a spaced apart outer wall defining an enclosed fluid chamber therebetween. The inner wall defines an enclosed steam chamber, a fluid input port in fluid communication with the enclosed steam chamber, a steam output port in fluid communication with the enclosed steam chamber, and a plurality of tubes passes through the enclosed steam chamber, wherein the plurality of tubes each define a first end, a second end and a passageway therebetween. A combustion chamber has an outer wall and a spaced apart inner wall defining a closed fluid chamber therebetween. The combustion chamber inner wall defines an air channel having a first end and an opposite second end, the combustion chamber air channel first end being coupled to a burner and the combustion chamber air channel second end being in fluid communication with the steam chamber plurality of tube first ends. A heat transfer section has an outer wall and at least one inner wall spaced apart from the outer wall so as to define a closed fluid chamber therebetween. The at least one inner wall defines an air passage having a first end and an opposite second end, the heat transfer section air passage second end being in fluid communication with the steam chamber plurality of tube second ends and the heat transfer section air passage first end being in fluid communication with a vacuum source. The heat transfer section fluid chamber is in fluid communication with the steam chamber fluid chamber, the steam chamber fluid chamber is in fluid communication with the combustion chamber fluid chamber, the combustion chamber fluid chamber is in fluid communication with the enclosed steam chamber, and when the burner generates a heated air mixture in the combustion chamber air channel, the vacuum source draws the heated air mixture from the combustion chamber air channel, through the steam chamber plurality of tubes and through the heat transfer section air passage so as to heat fluid passing through the heat transfer section, the steam chamber and the combustion chamber fluid chamber.

Another embodiment of the present invention provides a method of generating steam including the steps of providing a steam chamber having an outer wall and a spaced apart inner wall, the outer wall and the inner wall defining a closed fluid chamber therebetween. The inner wall defines an enclosed space, a fluid input port in fluid communication with the enclosed space, a steam output port in fluid communication with the enclosed space, and a plurality of tubes passes through the steam chamber enclosed space, wherein each of the plurality of tubes define a first end, a second end and a passageway therebetween. A combustion chamber has an outer wall and a spaced apart inner wall, the outer wall and the inner wall defining a closed fluid chamber therebetween and the inner wall defining an air passage having a first end and an opposite second end. The combustion chamber closed fluid chamber is in fluid communication with the steam chamber closed fluid chamber, and the combustion chamber closed fluid chamber is in fluid communication with the steam chamber enclosed space. A heat transfer section has an outer wall and at least one spaced apart inner wall so as to define a closed fluid chamber therebetween. The at least one inner wall defines an air passage having a first end and an opposite second end, wherein the heat transfer section closed fluid chamber is in fluid communication with the steam chamber closed fluid chamber. The method further includes pumping a fluid through the heat transfer section closed fluid chamber, the steam chamber closed fluid chamber and the combustion chamber closed fluid chamber into the steam chamber enclosed space; generating a heated air mixture in the combustion chamber air passage; drawing the heated air mixture through the combustion chamber air passage, the steam chamber plurality of tubes and the heat transfer section air passage; and generating steam in the steam chamber enclosed space using the heated air mixture passing through the steam chamber plurality of tubes.

The accompanying drawings, which are incorporated in and constitute a part of this specification, illustrate one or more embodiments of stacked displays of the present invention.

BRIEF DESCRIPTION OF THE DRAWINGS

A full and enabling disclosure of the present invention, including the best mode thereof, to one of ordinary skill in the art, is set forth more particularly in the remainder of the specification, including reference to the accompanying drawings, in which.

Figure 1:
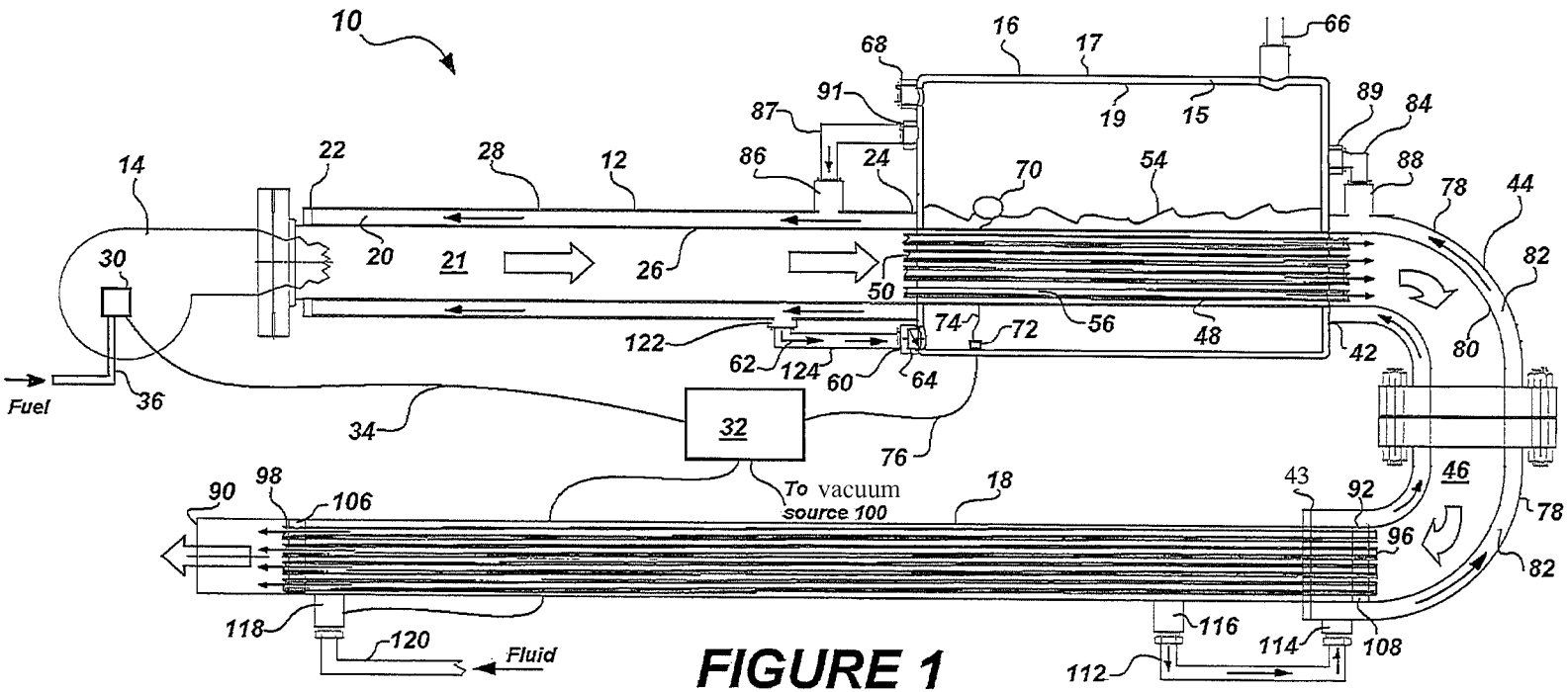
FIG. 1 is a side view of an embodiment of a steam generator in accordance with one embodiment of the present invention.

Repeat use of reference characters in the present specification and drawings is intended to represent same or analogous features or elements of the invention according to the disclosure.

DETAILED DESCRIPTION

Reference will now be made in detail to presently preferred embodiments of the invention, one or more examples of which are illustrated in the accompanying drawings. Each example is provided by way of explanation, not limitation, of the invention. It is to be understood by one of ordinary skill in the art that the present discussion is a description of exemplary embodiments only, and is not intended as limiting the broader aspects of the present invention, which broader aspects are embodied in the exemplary constructions. In fact, it will be apparent to those skilled in the art that modifications and variations can be made in the present invention without departing from the scope and spirit thereof. For instance, features illustrated or described as part of one embodiment may be used on another embodiment to yield a still further embodiment. Thus, it is intended that the present invention covers such modifications and variations as come within the scope of the appended claims and their equivalents.

Figure 3:
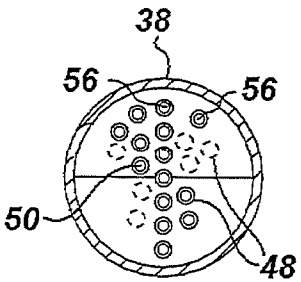
FIG. 3 is a partial sectional view of the steam chamber shown in FIG. 2.
Figure 2:
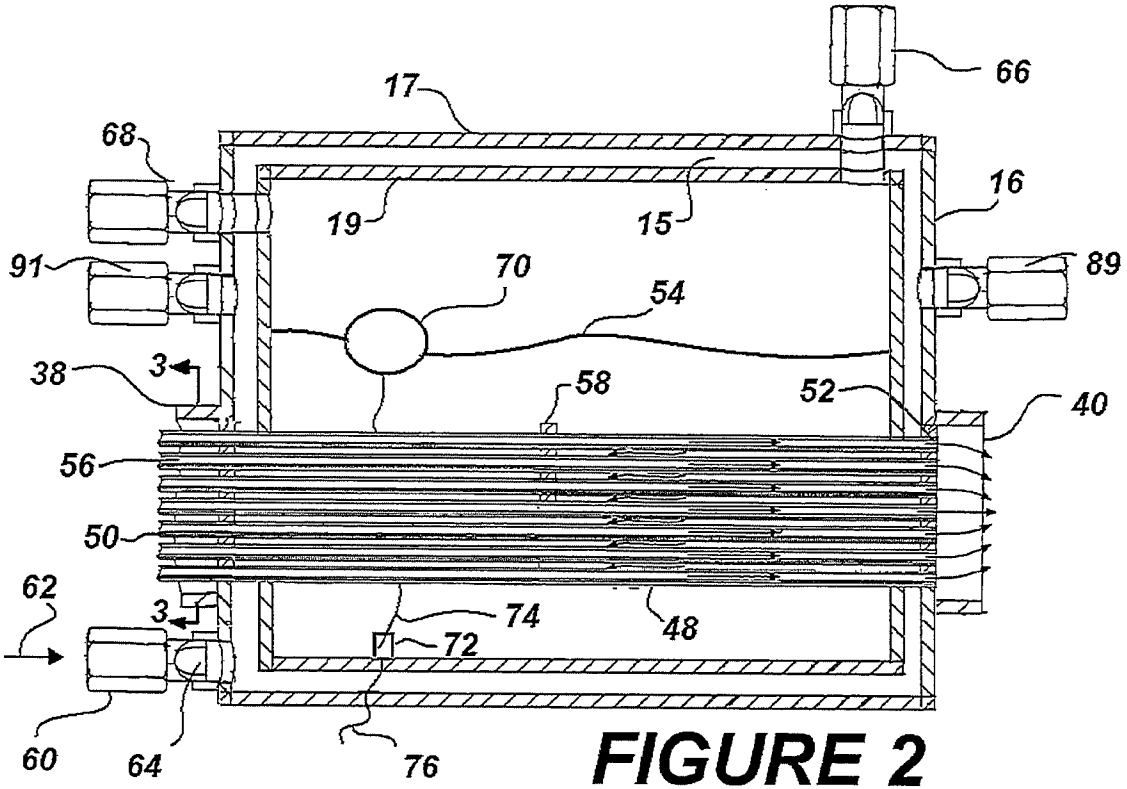
FIG. 2 is a partial side sectional view of a steam chamber for use in the steam generator of FIG. 1.

Referring to FIGS. 1-3, a steam generator 10 is shown having an elongated cylindrical closed combustion chamber 12, a burner 14, a steam chamber 16 and a heat exchanger 18. Elongated cylindrical chamber 12 is formed from a substantially double wall material that forms a liquid chamber 20. In one preferred embodiment, elongated cylindrical chamber 12 is about fifty-two inches long with a first end 22 and a second end 24. The walls of combustion chamber 12 may be formed from metals, metal alloys, ceramics, polymers or other suitable materials. In one preferred embodiment, the walls of chamber 18 are formed from an inner wall 26 and a spaced apart outer wall 28 that together define fluid chamber 20. Inner wall 26 defines an air channel 21 that extends from combustion chamber first end 22 to combustion chamber second end 24.

It should be understood that in other embodiments, combustion chamber 12 may be formed with a single wall and a fluid jacket may surround the outer surface of the combustion chamber. In these other embodiments, the purpose of the fluid jacket or fluid chamber 20 is to allow water to circulate around the outside surface of the combustion chamber so that the water absorbs the radiant heat generated by the combustion chamber. In all embodiments, it is important to understand that airflow into combustion chamber 12 must be controlled to increase the efficiency of combustion of the fuel delivered to burner 14. That is, the construction of combustion chamber 12 is designed to increase the efficiency of fuel burn while decreasing the byproducts of fuel combustion exhausted into the atmosphere.

Burner 14 is coupled to combustion chamber 12. In one preferred embodiment, burner 14 is a Power Flame CX40 burner manufactured by Power Flame Incorporated of Parsons, Kans. Burner 14 has valve 30 intermediate burner 14 and a controller 32 that allows the fuel supply to be cut-off from the burner by way of control lines 34. In this way, the burner may be adjusted to regulate the amount of heat generated in combustion chamber 12. Burner 14 may have an electronic computer controlled pilot light (not shown) associated with the burner. Each burner may be a fixed BTU burner or a modulating burner. The burner may also contain a fan to provide positive air pressure to burner 24. Suitable fuel for burner 14 may be propane, natural gas, biomass fuel or any other combustible fuel.

Referring particularly to FIGS. 2 and 3, steam chamber 16 is generally cylindrical in shape and has an outer wall 17 and a spaced apart inner wall 19. An enclosed fluid chamber is defined by a space 15 between outer wall 16 and inner wall 19. It should be understood that the steam chamber may take on any shape. A first end 38 of steam chamber 16 is configured to couple to combustion chamber second end 24. A second end 40 of steam chamber 16 is configured to couple to a first end 42 of an elbow joint 44. Steam chamber 16 also contains a plurality of input and output ports. In one preferred embodiment, steam chamber 16 has a fluid input port 60 that receives a flow of fluid 62. Positioned in input port 60 is a one-way check valve 64 that prevents fluid from flowing out of input port 60 as the pressure in steam chamber 16 increases. Steam chamber 16 also contains a steam output port 66 and an output pressure safety valve 68. In one preferred embodiment, output pressure safety valve has a cracking pressure of approximately 150 PSI.

Extending between steam chamber first end 38 and steam chamber second end 40 are a plurality of hollow tubes 48 having first open ends 50 opening into combustion chamber 12 and second open ends 52 that open into elbow 44. Steam chamber 16 may be formed from any suitable material such as metal, metal alloys, ceramics or polymers. Hollow tubes 48 may be formed from any heat conducting material such as metals, metal alloys, ceramics, polymers and other suitable materials. The length of tubes 48 may be equal to or greater than the length of steam chamber 16, or in some embodiments, may be longer if the tubes are zigzagged or coiled within steam chamber 16. In one preferred embodiment, tubes 48 are circular in cross-section. However, it should be understood that a cross-section of tubes 48 taken perpendicular to their length may be of various shapes, including by not limited to, a circle, a square, and other polygonal shapes. The number of tubes may also increase or decrease depending on the design of steam chamber 16.

The number of tubes and the physical dimension of the tubes should be chosen to increase the surface area between the walls of tubes 48 and fluid 54 contained in steam chamber 16. That is, tubes 48 are submerged in fluid contained in steam chamber 16 so that heat received in the hollow openings 56 of tube 48 (FIGS. 2 and 3) are efficiently transferred to the fluid in steam chamber 16. Tubes 48 are held in place by one or more plates 58 that define a plurality of holes (not numbered) that receive a respective tube. Each tube may be secured in a respective plate opening by welding or other suitable means that forms a sealed attachment. Plate 58 keeps tubes 48 from moving radially relative to one another.

A float 70 is operatively coupled to a switch 72 by a wire 74 or other suitable connection. Switch 72 is operatively coupled to controller 32 (FIG. 1) by a wire 76. Switch 72 is configured to provide signals to controller 32 when the water level reaches predetermined levels. More specifically, switch 72 is configured to stop the flow of water 62 from flowing in input 60 when the water level reaches a predetermined level in steam chamber 16, and to increase the flow of water 62 through input 60 when the water level drops below a predetermined level.

Referring again to FIG. 1, elbow joint 44 has first end 42 and a second end 43. Elbow joint 44 may be formed from two 90 degree bends that are fastened together or it may be formed integrally as a single bend. In either case, elbow joint 44 is formed from two spaced apart walls 78 and 80 that define a fluid chamber 82 therebetween. Fluid chamber 82 is in fluid communication with steam chamber fluid chamber 15 by piping 84. Piping 84 is in fluid communication with steam chamber fluid chamber 15 via an input port 89. Piping 84 is also in fluid communication with elbow fluid chamber 82 via an output port 88. Inner wall 80 defines an open air channel 46 that is in fluid communication with steam chamber tube hollow openings 56 and combustion chamber air channel 21. It should be understood that elbow joint 44 may also be formed from a single wall construction. In a single wall embodiment, a fluid jacket would be applied to the outer surface of the wall. An output port of the fluid jacket would connect to piping 84. Steam chamber fluid chamber 15 is in fluid communication with combustion chamber fluid chamber 20 via a steam chamber fluid chamber output port 91 that is in fluid communication with a combustion chamber fluid chamber input port 86 via piping 87.

As previously discussed above, elbow joint first end 42 is coupled to steam chamber 16 by a suitable connection. The connection may be formed by threads, screws, weldments or any other suitable means for connecting the elbow to the stream chamber. Elbow second end 43 is coupled to heat transfer section 18.

Still referring to FIG. 1, in one preferred embodiment, heat transfer section 18 is formed from an elongated cylinder having a first end 90 and second end 92. Heat transfer section second end 92 is configured to couple to elbow joint second end 43 by a clamp, connector or other suitable attachment means such as weldments. In some embodiments, elbow joint 44 and heat transfer section 18 may be integrally formed with one another. It should be understood that in other preferred embodiments, heat transfer section 18 may be formed in the shape of an elongated polygonal shaped body or other suitable form based on the devices intended use.

Figure 5:
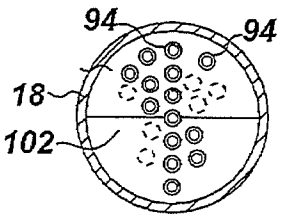
FIG. 5 is a cross-sectional view of the heat exchange section of FIG. 4.
Figure 4:
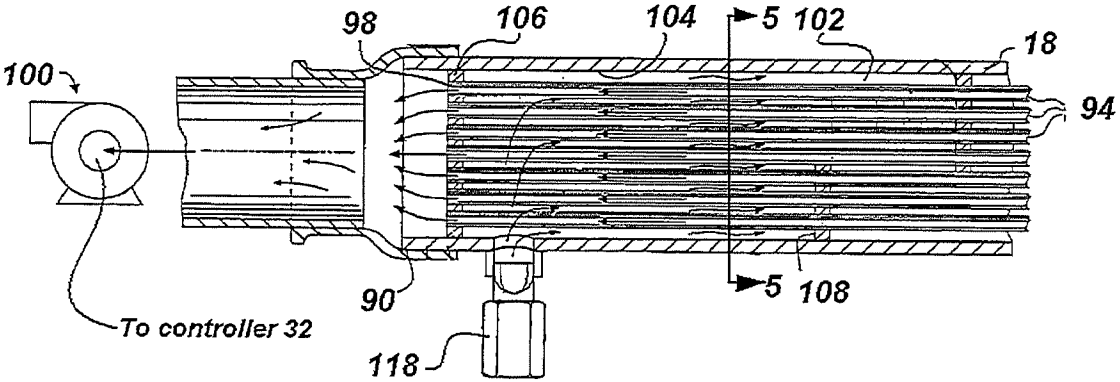
FIG. 4 is a partial side view of a heat exchange section of the steam generator shown in FIG. 1.

Referring particularly to FIGS. 4 and 5, heat transfer section 18 is hollow and contains a plurality of hollow tubes 94 having a first open end 96 (FIG. 1) opening into elbow joint open channel 46 and a second open end 98 that opens to a negative pressure source, which in one preferred embodiment is a vacuum pump 100. Heat transfer section 18 may be formed from any suitable material such as metal, metal alloys, ceramics or polymers. Hollow tubes 94 may be formed from any heat conducting material such as metals, metal alloys, ceramics, polymers and other suitable materials.

The length of tubes 94 may be less than or equal to the length of heat transfer section 18, or in some embodiments, may be longer if the tubes are zigzagged or coiled within heat transfer section 18. It should be understood that a cross-section of tubes 94 taken perpendicular to their length may be of various shapes, including by not limited to, a circle, a square, and other polygonal shapes. The number of tubes may also increase or decrease based on the outer diameter of each individual tube. In one preferred embodiment, the diameter of each tube is decreased and the number of tubes is increased to increase the surface area of the tubes that are in contact with the fluid surrounding the tubes.

The number of tubes and the physical dimension of the tubes defines a space 102, intermediate an outside surface of tubes 94 and an inner wall 104 of heat transfer section 18 that is sealed off from elbow joint open channel 46 and vacuum pump 100. Closed space 102 defines a chamber in which a fluid may be pumped through so that heat received in tubes 94 from elbow joint open channel 46 may be exchanged into the fluid via the tube walls. Tubes 94 are held in place in heat transfer section 18 by a plate 106 that defines a plurality of holes (not numbered) that receive a respective tube first open end 90. Each tube first open end 90 may be secured in a respective plate opening by welding or other suitable means that forms a sealed attachment. A similar plate 108 (FIG. 1) is positioned at heat transfer section second end 92 for securing and sealing tube second ends 96.

In other embodiments, heat transfer section 16 may be formed from a hollow cylinder that defines at least one bore extending from one end to the other. In this embodiment, an outside wall defining the bore and an inside wall of the hollow cylinder defines space 102. In this embodiment, a plurality of bores may be formed to increase the surface area exposed to elbow joint open channel 46 to increase the heat transfer efficiency.

In some embodiments, elbow joint 44 may be constructed similar to heat transfer section 18 where a plurality of tubes extend through a chamber defined by an outer wall. In other embodiments, elbow joint 44 may be eliminated and heat transfer section second end 92 may be bent to form a 180 degree turn so as to couple directly to steam chamber 16. In these embodiments, heat transfer section fluid chamber output port 114 would be in fluid communication with steam chamber fluid chamber input port 89.

Referring again to FIG. 1, elbow joint fluid chamber 82 is in fluid communication with heat transfer section closed space 102 via piping 112. Piping 112 is coupled to an input port 114 located proximate elbow joint second end 43, and to a heat transfer section output port 116 located proximate to heat transfer section second end 96. A fluid input port 118 for heat transfer section 18 is located proximate the heat transfer section first end 90.

It should be understood that in FIGS. 1-5, placement of the various fluid chamber input and output ports are for discussion purposes. In other embodiments, the location of the fluid input and output ports can vary depending on the use and/or dimensions of steam generator 10.

In operation, fluid used to generate steam is pumped from fluid source 120 into fluid input port 118. Fluid input port 118 allows fluid to enter heat transfer section 18 so that that fluid flow from source 120 enters into space 102 (FIG. 4), circulates through space 102 around the outer walls of tubes 94 and exits through output port 116 into elbow joint fluid chamber 82. A sensor located at, or in, fluid input port 118 senses the flow of fluid and provides a signal to controller 32. Controller 32 is programmed to provide a signal over wire 34 that opens burner valve 30 to allow fuel to flow into the burner. Burner 30 ignites and produces heated combustion in combustion chamber channel 21.

The fluid circulating through heat transfer section space 102 exits through heat transfer section output port 116, through piping 112 and into elbow joint fluid channel 82 via elbow joint input port 114. The fluid flow circulates about the length of the elbow joint and exits out of elbow joint output port 88 into piping 84. The fluid exits piping 84 and enters steam chamber fluid chamber 15 through steam chamber fluid chamber input port 89. The fluid circulates around steam chamber 16 and exits steam chamber fluid chamber 15 through steam chamber fluid chamber output port 91. The fluid travels through piping 87 and enters combustion chamber fluid chamber 20 via the combustion chamber fluid chamber input port 86. The fluid circulates around and along the length of the combustion chamber and exits the combustion chamber fluid chamber through combustion chamber fluid chamber output port 122. The fluid travels through piping 124 and passes through steam chamber input port 60.

As the fluid flows into steam chamber 16, the fluid level rises so that the fluid covers and circulates around steam chamber tubes 48. It should be understood that baffles (not shown) may be placed in any one of combustion fluid chamber 20, elbow joint fluid chamber 82 and heat transfer section fluid space 102 to help disburse the fluid throughout the various parts of the system to ensure even distribution of the fluid.

When controller 32 detects fluid flow at heat transfer section input port 118, controller 32 transmits a signal to burner 14 and vacuum source 100. Burner 14 ignites and generates an air and combustion mixture having a temperature of approximately 1600 degrees Fahrenheit. Vacuum source 100 generates negative pressure at heat transfer section first end 90 (FIG. 1). As the pressure drops, air is drawn through heat transfer section tubes 94 (FIGS. 1 and 4), elbow joint space 46, steam chamber tubes 48 and along the length of combustion chamber air channel 21. That is, the super heated air mixture generated by burner 14 in combustion chamber air channel 21 is drawn along the length of the connected air channel through the various parts of the system. As the super heated air is drawn through the combustion chamber, some of the heat is transferred into the fluid surrounding the combustion chamber.

The temperature of the super heated air drops from around 1600 degrees Fahrenheit in combustion chamber 12 to around 900 degrees Fahrenheit in elbow joint 44. As the heated air mixture passes through elbow joint 44, additional heat is transferred from the elbow joint inner wall into the fluid passing though elbow joint fluid chamber 82 thereby further decreasing the temperature of the air mixture passing through elbow joint second end 46. Moreover, as the heated air mixture enters heat transfer section tube second ends 96 and travels along the length of the tubes, additional heat is transferred through the tube walls into the fluid circulating in heat transfer space 102. Thus, the temperature of the heated air mixture that exists from heat transfer section first end 90 is approximately at 80 degrees Fahrenheit or approximately 20-30 degrees higher than the input water temperature.

All heat transferred from the various steam generator parts into the circulating fluid raises the efficiency of steam generator 10. That is, as the fluid enters heat transfer section 18 at input port 118, it is initially heated as it travels along the length of the heat transfer section. As the fluid passes through elbow joint fluid channel 82, additional heat is transferred into the fluid. Finally, as the fluid passes around combustion chamber 12 through combustion chamber fluid chamber 20, the fluid temperature is raised to a near boiling temperature prior to it being deposited into steam chamber 16. As the super heated air mixture is drawn through steam chamber tubes 48, fluid 54 residing in steam chamber 16 is converted into steam, which is transferred out of the steam chamber through steam chamber output port 66. Conversely, as the superheated air mixture is drawn through elbow joint 44 and heat transfer section 18, the temperature of the air mixture drops as heat is transferred to the circulating fluid. As a result, heat not used to generate steam in steam chamber 16 is reused to heat the new fluid entering steam generator 10.

It should be understood based on the configuration of steam generator 10 that the super heated air mixture is drawn through each component by a single pass. That is, the air flow through each component enters the component one time and exits the same component one time as the air flow moves through the system. This is referred to a "single pass" steam generator in that the airflow is not passed through a component multiple times as it traverses from the burner end of the combustion chamber out the first end of the heat transfer section.

Various sensors (not shown) may be placed throughout the system to sense the temperature of the heated fluid passing through the system. Moreover, various sensors (not shown) may also be used to sense the temperature of the heated air mixture. If the temperature of the fluid or air mixture is below a set temperature, burner 14 may be adjusted to raise or lower the temperature of one or both of the air mixture and the fluid. Steam generator 10 may be provided with various controls and safety devices to ensure that fluid is flowing through the system and a vacuum or positive air pressure is applied prior to igniting burner 14. Steam generator 10 is also provided with safety switches to shutdown the system if the fluid temperature exceeds a predetermined temperature or if the fluid or steam pressure exceeds a predetermined threshold. Thus, safety measures ensure that the system will not operate if fluid or vacuum pressure is not detected.

A source of electrical power (not shown), such as a 120 volt AC, a 3-phase 240 volt AC connection, or a connection to a battery, connects to vacuum source 100. An on-off switch (not shown) is also provided intermediate the power source and the vacuum pump to cut power to the entire system. As a result, when the on-off switch is closed, power is supplied to vacuum source 100.

While one or more preferred embodiments of the invention are described above, it should be appreciated by those skilled in the art that various modifications and variations can be made in the present invention without departing from the scope and spirit thereof. For example, the steam generator described herein may be used in various applications such as a steam generator for an apartment building, steam for sanitizing equipment, steam for food processing, or as a steam generator for a large-scale boiler system in a commercial setting. It is intended that the present invention cover such modifications and variations as come within the scope and spirit of the appended claims and their equivalents.

What is claimed is:

1. A steam generator comprising:

a steam chamber having an inner wall defining an enclosed steam chamber, an outer wall being spaced apart from the inner wall, an enclosed fluid chamber being defined by a space between the inner and outer walls of the steam chamber, and a plurality of tubes passing through the enclosed steam chamber, each one of the plurality of the tubes having a passageway extending between a first end of the tube and a second end of the tube;

a combustion chamber having an inner wall defining an enclosed air channel an outer wall being spaced apart from the inner wall, an enclosed fluid chamber being defined by a space between the inner and outer walls of the combustion chamber, the inner wall of the combustion chamber having a first end and an opposite second end, the first end of the inner wall of the combustion chamber being in fluid communication with a burner, and the second end of the inner wall of the combustion chamber being in fluid communication with the first ends of the plurality of the tubes of the steam chamber; and a heat transfer section having an inner wall defining an enclosed air channel, an outer wall being spaced apart from the inner wall, an enclosed fluid chamber being defined by a space between the inner and outer walls of the heat transfer section, the inner wall of the heat transfer section having a first end and an opposite second end, the second end of the inner wall of the heat transfer section being in fluid communication with the second ends of the plurality of the tubes of the steam chamber, and the first end of the inner wall of the heat transfer section being in fluid communication with a vacuum source;

wherein the steam generator is configured for pumping a fluid on a flow path constraining the fluid to circulate: from the enclosed fluid chamber of the heat transfer section to the enclosed fluid chamber of the steam chamber, and from the enclosed fluid chamber of the steam chamber to the enclosed fluid chamber of the combustion chamber, and from the enclosed fluid chamber of the combustion chamber to the enclosed steam chamber; and wherein the steam generator is configured for causing a heated air mixture to be generated by the burner and drawn by the vacuum source into the enclosed air channel of the combustion chamber, and for causing the heated air mixture to be drawn by the vacuum source from the enclosed air channel of the combustion chamber into the passageways of the plurality of the tubes of the steam chamber, and for causing the heated air mixture to be drawn by the vacuum source from the passageways of the plurality of the tubes of the steam chamber into the enclosed air channel of the heat transfer section.

2. The steam generator of claim 1, wherein the steam generator is configured for generating steam from the fluid.

3. The steam generator of claim 1, wherein the steam generator is configured for generating steam in the enclosed steam chamber from the fluid.

4. The steam generator of claim 1, wherein the first end of the inner wall of the combustion chamber is attached to the burner; and wherein the second end of the inner wail of the combustion chamber is attached to the first ends of the plurality of the tubes of the steam chamber; and wherein the second end of the inner wall of the heat transfer section is attached to the second ends of the plurality of the tubes of the steam chamber; and wherein the first end of the inner wall of the heat transfer section is attached to the vacuum source.

5. The steam generator of claim 1,being configured for causing the heated air mixture to pass: from the burner into the enclosed air channel of the combustion chamber; then into the passageways of the plurality of the tubes passing through the enclosed steam chamber; and then into the enclosed air channel of the heat transfer section.

6. The steam generator of claim 1,being configured for causing the heated air mixture to exit from the steam generator upon completing a single pass: from the burner into the enclosed air channel of the combustion chamber; then into the passageways of the plurality of the tubes passing through the enclosed steam chamber; and then into the enclosed air channel of the heat transfer section.

7. The steam generator of claim 1, further including a fluid input port being configured for causing a fluid to be pumped into the enclosed fluid chamber of the heat transfer section.

8. The steam generator of claim 7, being configured for causing the fluid to exit from the steam generator upon completing a single pass on the flow path: from the fluid input port to the enclosed fluid chamber of the heat transfer section; then to the enclosed fluid chamber of the steam chamber; then to the enclosed fluid chamber of the combustion chamber; then to the enclosed steam chamber; and then out of the steam chamber.

9. The steam generator of claim 1, wherein the vacuum source includes a vacuum pump.

10. The steam generator of claim 1, wherein the burner includes a fan being configured for providing positive air pressure to the burner.

11. A steam generator comprising:

a steam chamber having an inner wall defining an enclosed steam chamber, an outer wall being spaced apart from the inner wall, an enclosed fluid chamber being defined by a space between the inner and outer walls of the steam chamber, and a plurality of tubes passing through the enclosed steam chamber, each one of the plurality of the tubes having a passageway extending between a first end of the tube and a second end of the tube;

a combustion chamber having an inner wall defining an enclosed air channel, an outer wall being spaced apart from the inner wall, an enclosed fluid chamber being defined by a space between the inner and outer walls of the combustion chamber, the inner wall of the combustion chamber having a first end and an opposite second end, the first end of the inner wall of the combustion chamber being in fluid communication with a burner, and the second end of the inner wall of the combustion chamber being in fluid communication with the first ends of the plurality of the tubes of the steam chamber; and a heat transfer section having an inner wall defining an enclosed air channel, an outer wall being spaced apart from the inner wall, an enclosed fluid chamber being defined by a space between the inner and outer walls of the heat transfer section, the inner wall of the heat transfer section having a first end and an opposite second end, the second end of the inner wall of the heat transfer section being in fluid communication with the second ends of the plurality of the tubes of the steam chamber, and the first end of the inner wall of the heat transfer section being in fluid communication with a vacuum source;

wherein the steam generator is configured for pumping a fluid on a flow path constraining the fluid to circulate: from the enclosed fluid chamber of the heat transfer section to the enclosed fluid chamber of the steam chamber, and from the enclosed fluid chamber of the steam chamber to the enclosed fluid chamber of the combustion chamber, and from the enclosed fluid chamber of the combustion chamber to the enclosed steam chamber;

wherein the steam generator is configured for causing a heated air mixture to be generated by the burner and drawn by the vacuum source into the enclosed air channel of the combustion chamber, and for causing the heated air mixture to be drawn by the vacuum source from the enclosed air channel of the combustion chamber into the passageways of the plurality of the tubes of the steam chamber, and for causing the heated air mixture to be drawn by the vacuum source from the passageways of the plurality of the tubes of the steam chamber into the enclosed air channel of the heat transfer section; and wherein the heat transfer section further includes another plurality of tubes passing through and collectively forming the inner wall of the heat transfer section, each one of the another plurality of tubes having a passageway extending between a first end of the another tube and a second end of the another tube, the passageways of the another plurality of the tubes collectively forming the enclosed air channel of the heat transfer section.

12. The steam generator of claim 11, wherein the steam generator is configured for generating steam from the fluid.

13. The steam generator of claim 11, wherein the steam generator is configured for generating steam in the enclosed steam chamber from the fluid.

14. The steam generator of claim 11, wherein the first end of the inner wall of the combustion chamber is attached to the burner; and wherein the second end of the inner wall of the combustion chamber is attached to the first ends of the plurality of the tubes of the steam chamber; and wherein the second end of the inner wall of the heat transfer section is attached to the second ends of the plurality of the tubes of the steam chamber; and wherein the first end of the inner wall of the heat transfer section is attached to the vacuum source.

15. The steam generator of claim 11, being configured for causing the heated air mixture to pass: from the burner into the enclosed air channel of the combustion chamber; then into the passageways of the plurality of the tubes passing through the enclosed steam chamber; and then into the enclosed air channel of the heat transfer section.

16. The steam generator of claim 11, being configured for causing the heated air mixture to exit from the steam generator upon completing a single pass: from the burner into the enclosed air channel of the combustion chamber; then into the passageways of the plurality of the tubes passing through the enclosed steam chamber; and then into the enclosed air channel of the heat transfer section.

17. The steam generator of claim 11, further including a fluid input port being configured for causing a fluid to be pumped into the enclosed fluid chamber of the heat transfer section.

18. The steam generator of claim 17, being configured for causing the fluid to exit from the steam generator upon completing a single pass on the flow path: from the fluid input port to the enclosed fluid chamber of the heat transfer section; then to the enclosed fluid chamber of the steam chamber; then to the enclosed fluid chamber of the combustion chamber; then to the enclosed steam chamber; and then out of the steam chamber.

19. The steam generator of claim 11, wherein the vacuum source includes a vacuum pump.

20. The steam generator of claim 11, wherein the burner includes a fan being configured for providing positive air pressure to the burner.

21. A steam generator comprising:

a steam chamber having an inner wall defining an enclosed steam chamber, an outer wall being spaced apart from the inner wall, an enclosed fluid chamber being defined by a space between the inner and outer walls of the steam chamber, and a plurality of tubes passing through the enclosed steam chamber, each one of the plurality of the tubes having a passageway extending between a first end of the tube and a second end of the tube;

a combustion chamber having a wall defining an enclosed air channel, the wall of the combustion chamber having a first end and an opposite second end, the first end of the wall of the combustion chamber being in fluid communication with a burner, and the second end of the wall of the combustion chamber being in fluid communication with the first ends of the plurality of the tubes of the steam chamber, and the combustion chamber further having a fluid jacket surrounding an outside surface of the wall of the combustion chamber; and a heat transfer section having an inner wall defining an enclosed air channel, an outer wall being spaced apart from the inner wall, are enclosed fluid chamber being defined by a space between the inner and outer walls of the heat transfer section, the inner wall of the heat transfer section having a first end and an opposite second end, the second end of the inner wall of the heat transfer section being in fluid communication with the second ends of the plurality of the tubes of the steam chamber, and the first end of the inner wall of the heat transfer section being in fluid communication with a vacuum source;

wherein the steam generator is configured for pumping a fluid on a flow path constraining the fluid to circulate: from the enclosed fluid chamber of the heat transfer section to the enclosed fluid chamber of the steam chamber, and from the enclosed fluid chamber of the steam chamber to the fluid jacket of the combustion chamber, and from the fluid jacket of the combustion chamber to the enclosed steam chamber; and wherein the steam generator is configured for causing a heated air mixture to be generated by the burner and drawn by the vacuum source into the enclosed air channel of the combustion chamber, and for causing the heated air mixture to be drawn by the vacuum source from the enclosed air channel of the combustion chamber into the passageways of the plurality of the tubes of the steam chamber, and for causing the heated air mixture to be drawn by the vacuum source from the passageways of the plurality of the tubes of the steam chamber into the enclosed air channel of the heat transfer section.

22. The steam generator of claim 21, wherein the steam generator is configured for generating steam from the fluid.

23. The steam generator of claim 21, wherein the steam generator is configured for generating steam in the enclosed steam chamber from the fluid.

24. The steam generator of claim 21, including another plurality of tubes passing through and collectively forming the inner wall of the heat transfer section, each one of the another plurality of the tubes having a passageway extending between a first end of the another tube and a second end of the another tube, the passageways of the another plurality of the tubes collectively forming the enclosed air channel of the heat transfer section.

25. The steam generator of claim 21, being configured for causing the heated air mixture to pass: from the burner into the enclosed air channel of the combustion chamber; then into the passageways of the plurality of the tubes passing through the enclosed steam chamber; and then into the enclosed air channel of the heat transfer section.

26. The steam generator of claim 21, being configured for causing the heated air mixture to exit from the steam generator upon completing a single pass: from the burner into the enclosed air channel of the combustion chamber; then into the passageways of the plurality of the tubes passing through the enclosed steam chamber; and then into the enclosed air channel of the heat transfer section.

27. The steam generator of claim 21, further including a fluid input port being configured for causing a fluid to be pumped into the enclosed fluid chamber of the heat transfer section.

28. The steam generator of claim 27, being configured for causing the fluid to exit from the steam generator upon completing a single pass on the flow path: from the fluid input port to the enclosed fluid chamber of the heat transfer section; then to the enclosed fluid chamber of the steam chamber; then to the fluid jacket of the combustion chamber; then to the enclosed steam chamber; and then out of the steam chamber.

29. The steam generator of claim 21, wherein the vacuum source includes a vacuum pump.

30. The steam generator of claim 21, wherein the burner includes a fan being configured for providing positive air pressure to the burner.

31. A steam generating process, comprising:

providing a steam generator that includes;

a steam chamber having an inner wall defining an enclosed steam chamber, an outer wall being spaced apart from the inner wall, an enclosed fluid chamber being defined by a space between the inner and outer walls of the steam chamber, and a plurality of tubes passing through the enclosed steam chamber, each one of the plurality of the tubes having a passageway extending between a first end of the tube and a second end of the tube;

a combustion chamber having an inner wall defining, an enclosed air channel, an outer wall being spaced apart from the inner wall, an enclosed fluid chamber being defined by a space between the inner and outer walls of the combustion chamber, the inner wall of the combustion chamber having a first end and an opposite second end, the first end of the inner wall of the combustion chamber being in fluid communication with a burner, and the second end of the inner wall of the combustion chamber being in fluid communication with the first ends of the plurality of the tubes of the steam chamber; and a heat transfer section having an inner wall defining an enclosed air channel, an outer wall being spaced apart from the inner wall, an enclosed fluid chamber being defined by a space between the inner and outer walls of the heat transfer section, the inner wall of the heat transfer section having a first end and an opposite second end, the second end of the inner wall of the heat transfer section being in fluid communication with the second ends of the plurality of the tubes of the steam chamber, and the first end of the inner wall of the heat transfer section being in fluid communication with a vacuum source; and pumping a fluid on a flow path constraining the fluid to circulate: from the enclosed fluid chamber of the heat transfer section to the enclosed fluid chamber of the steam chamber, and from the enclosed fluid chamber of the steam chamber to the enclosed fluid chamber of the combustion chamber, and from the enclosed fluid chamber of the combustion chamber to the enclosed steam chamber; and causing a heated air mixture to be generated by the burner and drawn by the vacuum source into the enclosed air channel of the combustion chamber, and causing the heated air mixture to be drawn by the vacuum source from the enclosed air channel of the combustion chamber into the passageways of the plurality of the tubes of the steam chamber, and causing the heated air mixture to be drawn by the vacuum source from the passageways of the plurality of the tubes of the steam chamber into the enclosed air channel of the heat transfer section.

32. The steam generating process of claim 31, including generating steam from the fluid.

33. The steam generating process of claim 31, including generating steam in the enclosed steam chamber from the fluid.

34. The steam generating process of claim 31, including causing the heated air mixture to pass: from the burner into the enclosed air channel of the combustion chamber; then into the passageways of the plurality of the tubes passing through the enclosed steam chamber; and then into the enclosed air channel of the heat transfer section.

35. The steam generating process of claim 31, including causing the heated air mixture to exit from the steam generator upon completing a single pass: from the burner into the enclosed air channel of the combustion chamber; then into the passageways of the plurality of the tubes passing through the enclosed steam chamber; and then into the enclosed air channel of the heat transfer section.

36. The steam generating process of claim 31, wherein providing the steam generator includes providing a fluid input port being in fluid communication with the enclosed fluid chamber of the heat transfer section, and wherein the process includes causing a fluid to be pumped through the fluid input port into the enclosed fluid chamber of the heat transfer section.

37. The steam generating process of claim 36, wherein the process includes causing the fluid to exit from the steam generator upon completing a single pass on the flow path: from the fluid input port to the enclosed fluid chamber of the heat transfer section; then to the enclosed fluid chamber of the steam chamber; then to the enclosed fluid chamber of the combustion chamber; then to the enclosed steam chamber; and then out of the steam chamber.

38. A steam generating process, comprising:

providing a steam generator that includes:

a steam chamber having an inner wall defining an enclosed steam chamber, an outer wall being spaced apart from the inner wall, an enclosed fluid chamber being defined by a space between the inner and outer walls of the steam chamber, and a plurality of tubes passing through the enclosed steam chamber, each one of the plurality of the tubes having a passageway extending between a first end of the tube and a second end of the tube;

a combustion chamber having a wall defining an enclosed air channel, the wall of the combustion chamber having a first end and an opposite second end, the first end of the wall of the combustion chamber being in fluid communication with a burner, and the second end of the wall of the combustion chamber being in fluid communication with the first ends of the plurality of the tubes of the steam chamber, and the combustion chamber further having a fluid jacket surrounding an outside surface of the wall of the combustion chamber; and a heat transfer section having an inner wall defining an enclosed air channel, an outer wall being spaced apart from the inner wall, an enclosed fluid chamber being defined by a space between the inner and outer walls of the heat transfer section, the inner wall of the heat transfer section having a first end and an opposite second end, the second end of the inner wall of the heat transfer section being in fluid communication with the second ends of the plurality of the tubes of the steam chamber, and the first end of the inner wall of the heat transfer section being in fluid communication with a vacuum source; and pumping a fluid on a flow path constraining the fluid to circulate: from the enclosed fluid chamber of the heat transfer section to the enclosed fluid chamber of the steam chamber, and from the enclosed fluid chamber of the steam chamber to the fluid jacket of the combustion chamber, and from the fluid jacket of the combustion chamber to the enclosed steam chamber; and causing a heated air mixture to be generated by the burner and drawn by the vacuum source into the enclosed air channel of the combustion chamber, and causing the heated air mixture to be drawn by the vacuum source from the enclosed air channel of the combustion chamber into the passageways of the plurality of the tubes of the steam chamber, and causing the heated air mixture to be drawn by the vacuum source from the passageways of the plurality of the tubes of the steam chamber into the enclosed air channel of the heat transfer section.

39. The steam generating process of claim 38, including generating steam from the fluid.

40. The steam generating process of claim 38, including generating steam in the enclosed steam chamber from the fluid.

41. The steam generating process of claim 38, including causing the heated air mixture to pass: from the burner into the enclosed air channel of the combustion chamber; then into the passageways of the plurality of the tubes passing through the enclosed steam chamber; and then into the enclosed air channel of the heat transfer section.

42. The steam generating process of claim 38, including causing the heated air mixture to exit from the steam generator upon completing a single pass: from the burner into the enclosed air channel of the combustion chamber; then into the passageways of the plurality of the tubes passing through the enclosed steam chamber; and then into the enclosed air channel of the heat transfer section.

43. The steam generating process of claim 38, wherein providing the steam generator includes providing a fluid input port being in fluid communication with the enclosed fluid chamber of the heat transfer section, and wherein the process includes causing a fluid to be pumped through the fluid input port into the enclosed fluid chamber of the heat transfer section.

44. The steam generating process of claim 43, wherein the process includes causing the fluid to exit from the steam generator upon completing a single pass on the flow path: from the fluid input port to the enclosed fluid chamber of the heat transfer section; then to the enclosed fluid chamber of the steam chamber; then to the fluid jacket of the combustion chamber; then to the enclosed steam chamber; and then out of the steam chamber.

* * * * *